US012590399B2

(12) United States Patent
Huang et al.

(10) Patent No.: US 12,590,399 B2
(45) Date of Patent: Mar. 31, 2026

(54) EJECTOR, DISPENSING DEVICE AND LAUNDRY TREATMENT APPLIANCE

(71) Applicants: QINGDAO HAIER LAUNDRY ELECTRIC APPLIANCES CO., LTD., Qingdao (CN); HAIER SMART HOME CO., LTD., Qingdao (CN)

(72) Inventors: Tao Huang, Qingdao (CN); Haifeng Ren, Qingdao (CN); Huacheng Zhang, Qingdao (CN)

(73) Assignees: QINGDAO HAIER LAUNDRY ELECTRIC APPLIANCES CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 134 days.

(21) Appl. No.: 18/293,492

(22) PCT Filed: Jun. 21, 2022

(86) PCT No.: PCT/CN2022/100075
§ 371 (c)(1),
(2) Date: Jan. 30, 2024

(87) PCT Pub. No.: WO2023/005511
PCT Pub. Date: Feb. 22, 2023

(65) Prior Publication Data

US 2025/0116051 A1 Apr. 10, 2025

(30) Foreign Application Priority Data

Jul. 30, 2021 (CN) ..... 202110868936.6
Jul. 30, 2021 (CN) ..... 202110868944.0

(51) Int. Cl.
*D06F 39/08* (2006.01)
*D06F 39/02* (2006.01)

(52) U.S. Cl.
CPC ..... *D06F 39/088* (2013.01); *D06F 39/081* (2013.01); *D06F 39/028* (2013.01)

(58) Field of Classification Search
CPC ..... D06F 39/088; D06F 39/081; D06F 39/028
See application file for complete search history.

(56) References Cited

U.S. PATENT DOCUMENTS 3,174,489 A * 3/1965 Jellies ..... D06F 39/087 200/83 Z
3,862,640 A * 1/1975 Hechler, IV ..... E03C 1/108 137/1

(Continued)

FOREIGN PATENT DOCUMENTS

CN 104562566 A * 4/2015 ..... D06F 37/00
CN 110410371 A 11/2019

(Continued)

OTHER PUBLICATIONS

PCT/CN2022/100075—International Search Report Aug. 15, 2022.

*Primary Examiner* — Benjamin L Osterhout
(74) *Attorney, Agent, or Firm* — Sand, Sebolt & Wernow Co., LPA

(57) ABSTRACT

An ejector for a laundry treatment appliance includes a housing with a flow channel for allowing water flow to flow therethrough. The housing defines a gap which communicates the flow channel with the outside atmosphere. An axis of an ejection hole of the flow channel located upstream of the gap is coaxial with an axis of an injection hole located downstream of the gap. Backflow water is discharged from the ejector's gap. Since the ejection hole and injection hole are on opposite sides of the housing, and because their diameters are approximately equal water flowing to the injection hole covers as much of the injection hole as possible. The waterway's inlet end downstream of the injection hole is closed to maintain pressure. During supply (Continued)

of water, water flow is prevented from passing through the gap and relieving pressure.

19 Claims, 9 Drawing Sheets

(56) References Cited

U.S. PATENT DOCUMENTS

| | | | | | |
|---|---|---|---|---|---|
| 5,522,419 | A * | 6/1996 | Sand | B01F 25/31243 137/216 |
| 9,409,134 | B1 * | 8/2016 | Jones | B01F 25/312 |
| 2005/0252549 | A1 * | 11/2005 | Hague | B01F 25/312 137/216 |
| 2009/0000024 | A1 * | 1/2009 | Louis | E03C 1/046 222/1 |
| 2012/0024021 | A1 * | 2/2012 | Seo | D06F 39/028 137/215 |
| 2014/0102543 | A1 * | 4/2014 | Grant | B01F 35/75441 137/115.11 |

FOREIGN PATENT DOCUMENTS

| | | | | |
|---|---|---|---|---|
| CN | 110983722 | A | 4/2020 | |
| CN | 111032948 | A | 4/2020 | |
| CN | 111621961 | A | 9/2020 | |
| CN | 112376221 | A | 2/2021 | |
| EP | 2860301 | A1 * | 4/2015 | D06F 37/00 |
| JP | 2004331088 | A * | 11/2004 | B67D 1/0086 |
| WO | WO-2019044305 | A1 * | 3/2019 | D06F 39/08 |
| WO | 2021023113 | A | 2/2021 | |

* cited by examiner

EJECTOR, DISPENSING DEVICE AND LAUNDRY TREATMENT APPLIANCE

FIELD

The present disclosure relates to the field of laundry treatment appliance, in particular to an ejector applied to a water supply waterway of laundry treatment appliance, and also relates to a dispensing device having a function of supplying water to the laundry treatment appliance, in particular to a dispensing device equipped with the ejector.

BACKGROUND

With the development of the economic level, washing appliance is used in most users'homes. With the improvement of living standards, washing appliance not only has a single washing function, but also has many other functions, such as drying and ironing. The washing appliance with various functions is collectively referred to as laundry treatment appliance.

However, regardless of any function, the laundry treatment appliance is generally provided with a dispensing device, so that different water supply waterways arranged on the dispensing device can be used to supply water to different components, where water is needed, of the laundry treatment appliance. Meanwhile, the dispensing device of the existing laundry treatment appliance is provided with a dispensing chamber for dispensing one or more additives, so that the additives in the dispensing chamber can be dispensed correspondingly along with the different water supply waterways arranged on the dispensing device so as to realize different laundry treatment functions of the laundry treatment appliance.

However, the existing dispensing device has the following problems in structure.

In supplying water in the laundry treatment appliance, when situations such as damage of a water inlet tap, falling of a water inlet pipe, and cutting off water supply to a user's home happen, a negative pressure may be generated at the water inlet pipe of the laundry treatment appliance. In particular, when the water supply is cut off in the user's community and the user is located at a too high floor level, a negative pressure is generated in the tap water supply pipeline of the user, so that the water flow mixed with the additives in the water supply waterway of the laundry treatment appliance flows reversely to the tap water pipe, thereby causing contamination to the water supply source of the user's home.

In the prior art, a one-way check valve is generally arranged at the water inlet of the water supply waterway of the laundry treatment appliance to solve the above-mentioned problems. But the one-way check valve has a possibility of failure, to cause the water supply system of the entire laundry treatment appliance to be unreliable.

In view of this, the present disclosure is provided to solve the above problems.

SUMMARY

The present disclosure provides an ejector and a water supply waterway with the ejector to allow the pressurized fluid to flow and prevent from flowing back. A laundry treatment appliance with a dispensing device with the above ejector is provided, to maintain the pressure of the downstream waterway of the backflow-preventing gap and prevent the water flow passing through the backflow-preventing gap from relieving pressure.

In order to achieve the above object of the disclosure, the specific solutions adopted by the present disclosure are as follows.

The present application provides an ejector for laundry treatment appliance, comprising, a housing with a flow channel in the house for allowing water flow to flow through. The housing is provided with a gap for communicating the flow channel with the outside atmosphere, the flow channel of the housing is internally provided with an ejection hole located on an upstream of the gap and an injection hole located on a downstream of the gap, and an axis of the ejection hole is coaxial with an axis of the injection hole. A diameter of the ejection hole is approximately equal to a diameter of the injection hole.

As an embodiment, the housing is in a shape of a cylinder, a hollow portion in the cylinder forms the flow channel, and a side wall of the housing with a shape of a cylinder is provided with a notch for communicating a space between the injection hole and the ejection hole with the outside atmosphere.

As an embodiment, the flow channel of the housing is internally provided with a front end wall located upstream of the gap and a rear end wall located downstream of the gap. The ejection hole is formed in the front end wall, and the injection hole is formed in the rear end wall.

Preferably, the front end wall and the rear end wall are both perpendicular to an axis of the housing with a shape of a cylinder.

As an embodiment, a part of the housing between the front end wall and the rear end wall forms a connection portion, and an axis of the connection portion is extended in a straight line. The axis of the connection portion coincides with, or is parallel to, the axis of the injection hole and the axis of the ejection hole.

Preferably, the axis of the ejection hole and the axis of the injection hole are arranged substantially at the axis of the cylindrical housing, and a diameter of the injection hole is slightly smaller than a diameter of the ejection hole.

Preferably, a difference between the diameter of the injection hole and the diameter of the ejection hole is smaller than or equal to one fifth of the diameter of the injection hole.

Further preferably, the difference between the diameter of the injection hole and the diameter of the ejection hole is smaller than or equal to one tenth of the diameter of the injection hole.

As an embodiment, the ejector also comprises a front chamber portion arranged on an upstream of the front end wall. A flow channel in the front chamber portion communicates with the ejection hole.

Preferably, the front chamber portion and the connection portion are integrated; or, the front chamber portion is separated from and fixedly connected with the connection portion.

Preferably, the flow channel in the front chamber portion is coaxial with the ejection hole.

As an embodiment, an upstream end of the flow channel in the front chamber portion is a water inlet of the ejector, a downstream end of the flow channel communicates with the ejection hole, and the flow channel of the front chamber portion is a narrowed flow channel with a cross-sectional area gradually decreasing in a direction from the water inlet to the ejection hole.

As an embodiment, a first flow channel with invariable diameter is arranged between a small mouth end of the narrowed flow channel of the front chamber portion and an end face of the ejection hole, and a second flow channel with invariable diameter is arranged between a large mouth end of the narrowed flow channel and an end face of the water inlet.

As an embodiment, the ejector also comprises a rear chamber portion arranged on a downstream of the rear end wall. A flow channel in the rear chamber portion communicates with the injection hole, and the rear chamber portion is provided with a variable-diameter flow channel with a cross-sectional dimension gradually increasing in the direction of water flow. A small mouth end of the variable-diameter flow channel communicates with the injection hole, and a large mouth end of the variable-diameter flow channel forms a water outlet of the ejector.

Preferably, the rear chamber portion and the connection portion are integrated; or, the rear chamber portion is separated from and fixedly connected with the connection portion.

Preferably, the flow channel in the rear chamber portion is coaxial with the injection hole.

Further, the front chamber portion, the rear chamber portion and the connection portion are integrated as one piece, and the one piece forms the housing of the ejector.

The present disclosure also provides a dispensing device. The dispensing device is provided with a water supply waterway, and the above ejector is arranged in the water supply waterway.

The present disclosure also provides a laundry treatment appliance. The above dispensing device is arranged in the laundry treatment appliance.

The present disclosure has significant technical advantages over the prior art as follows.

According to the present disclosure, by the arrangement of the gap for communicating the flow channel with the outside atmosphere, the backflow water is discharged from the gap of the ejector, to preventing water in the waterway in which the ejector is arranged from flowing back. The ejection hole and the injection hole are arranged on two sides opposite to each other of the housing of the ejector, and the diameters of them are same, so the water flow flowing to the injection hole can cover the injection hole as much as possible, and the inlet end of the waterway downstream of the injection hole is closed to maintain the pressure of the waterway. During supplying water, it is prevented that the water flow passing through the backflow-preventing gap from relieving pressure due to the arrangement of the gap.

The present disclosure provides an ejector and a dispensing device with an ejector, to allow the pressurized fluid to flow and prevent from flowing back. A laundry treatment appliance with a dispensing device with the above ejector is provided, to prevent the waterway with an ejector from leaking water.

In order to achieve the above object of the disclosure, the specific solutions employed by the present disclosure are as follows.

A dispensing device comprises a water supply waterway. The water supply waterway is provided with an ejector, and the ejector is provided with a backflow-preventing gap for discharging the backflow water in a downstream of water supply waterway. An opening corresponding to the backflow-preventing gap is formed in the water supply waterway. A sealing structure is arranged between the ejector and an inner wall of the water supply waterway and configured to separate the opening from the water supply waterway on the upstream and downstream of the ejector.

As an embodiment, positions of the housing of the ejector on the upstream and the downstream of the backflow-preventing gap are respectively provided with at least one sealing ring being radially outwardly protruded.

As an embodiment, the housing of the ejector is in a shape of cylinder, a flow channel is formed in the housing with a shape of cylinder in axial direction, and a middle part of a peripheral wall of the housing with a shape of cylinder is provided with a notch being as the backflow-preventing gap for communicating the flow channel inside the ejector with the outside atmosphere. The at least one sealing ring being radially outwardly protruded is arranged on an outer wall of the housing of the ejector on two sides of the backflow-preventing gap, respectively. A periphery of the sealing ring is in hermetically contact with an inner wall of the water supply waterway for forming a sealing structure.

Preferably, the sealing ring is close to the backflow-preventing gap.

Further preferably, the outer wall of the housing with a shape of cylinder is provided with a mounting groove being inwardly recessed, and the sealing ring is arranged in the mounting groove.

As an embodiment, the water supply waterway comprises a mounting chamber arranged on an upper cover of the dispensing device and upward protruded.

The mounting chamber with a shape of strip is horizontally extended, and a bottom of the mounting chamber is provided with the opening.

The ejector is in a shape of cylinder, and the ejector is inserted into and coaxial with the mounting chamber with a shape of strip, and the backflow-preventing gap is formed at the middle of the side wall of the ejector, and the backflow-preventing gap is arranged above the opening.

At least one sealing ring is respectively arranged on the side wall of the ejector located on two sides of the backflow-preventing gap, and the periphery of the sealing ring is hermetically contact with the inner wall of the mounting chamber.

As an embodiment, two ends of the mounting chamber with a shape of strip respectively communicate with a water inlet chamber and a water outlet chamber.

The sealing ring located on the upstream of the backflow-preventing gap on the ejector with a shape of cylinder is arranged downstream a junction between the mounting chamber with a shape of strip and the water inlet chamber.

The sealing ring located on the downstream of the backflow-preventing gap on the ejector with a shape of cylinder is arranged upstream a junction between the mounting chamber with a shape of strip and the water outlet chamber.

As an embodiment, the water inlet chamber is arranged below the mounting chamber, and a bottom wall of a water inlet end of the mounting chamber with a shape of strip is provided with a through hole communicating with the water inlet chamber below.

At least part of the ejector is located above the through hole, and the end of the ejector located above the through hole is a water inlet, and the water inlet is spaced from the end of the mounting chamber with a shape of strip.

As an embodiment, the water outlet chamber is in a strip shape coaxial with the mounting chamber, a radial dimension of the water outlet chamber is greater than a radial dimension of the ejector with a shape of cylinder, and an axial length of the water outlet chamber is greater than or equal to a axial length of the ejector with a shape of cylinder.

A top wall of the water outlet chamber is formed by a cover plate detachably mounted on the upper cover.

As an embodiment, at least part of the ejector with a shape of cylinder is located in the water outlet chamber, and an end of the ejector with a shape of cylinder located in the water outlet chamber forms a water outlet.

The outer wall of the ejector with a shape of cylinder is provided with a mounting rib being outward protruded, and a protruding length of the mounting rib is greater than a difference between a radial dimension of the mounting chamber and a radial dimension of the periphery of the ejector with a shape of cylinder.

Preferably, the mounting rib is extended in a tangential direction to the outer wall of the ejector with a shape of cylinder, and a distance between an end of the mounting rib and a center axis of the ejector with a shape of cylinder is greater than the radial dimension of the mounting chamber.

As an embodiment, a top of the upper cover is provided with a positioning groove communicating with the water outlet chamber and arranged at one side of the water outlet chamber, and the positioning groove is arranged at a junction of the water outlet chamber and the mounting chamber. The mounting rib of the ejector is correspondingly inserted into the positioning groove. After the ejector is inserted in the mounting chamber from the water outlet chamber, the ejector rotates about an axis, and the mounting rib is inserted in the positioning groove from the opening of the upper.

The present application provides a laundry treatment appliance, and the above the dispensing device is arranged in the laundry treatment appliances.

The present disclosure has significant technical advantages over the prior art as follows.

According to the present application, by arranging the gap on the ejector for communicating the flow channel with the outside atmosphere, the backflow water is discharged from the ejector, so it is prevented water in the waterway in which the ejector is arranged from flowing back. The variable-diameter flow channel widening in the direction of the inlet water flow is arranged downstream of the gap of the ejector, to hinder water to flow back, thereby reducing the flow rate of the backflow water into the connection portion, and further reducing the possibility of the backflow water to flow into the front chamber portion of the ejector. The backflow water is effectively prevented from flowing back into the upstream tap water pipe to contaminate the upstream tap water pipe.

The sealing structure is arranged on a position between the ejector and waterway, so the waterways on the downstream and the upstream of the backflow-preventing gap of the ejector are separated from each other, and water flow in the supply waterway cannot directly flow to gap. Thereby water cannot be leaked from the waterway provided with a ejector.

The present disclosure is simple in structure, remarkable in effect, and suitable for widespread use.

Specific embodiments of the disclosure will be described in further detail below with reference to the accompanying drawings.

BRIEF DESCRIPTION OF THE DRAWINGS

The accompanying drawings are incorporated in and constitute a part of this disclosure for further understanding the disclosure, illustrative embodiments of the disclosure and the description thereof are provided for explaining the disclosure, but are not to be construed as unduly limiting of the disclosure. Apparently, the accompanying drawings in the following description are merely some embodiments, for a skilled person in the art, other drawings can also be obtained according to these accompanying drawings without paying no creative labor.

Figure 1:
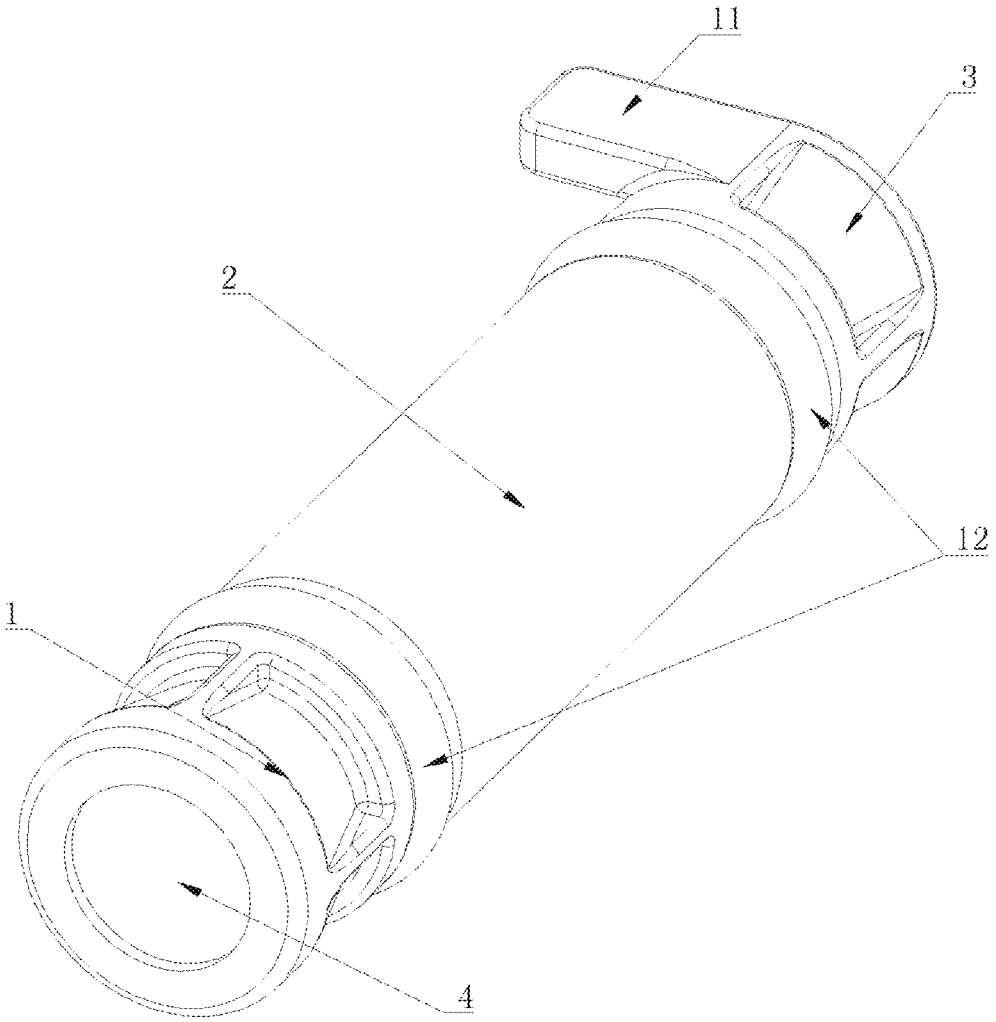
FIGS. 1-3 are schematic diagrams of an ejector at different viewing angles according to an embodiment of the present disclosure.
Figure 2:
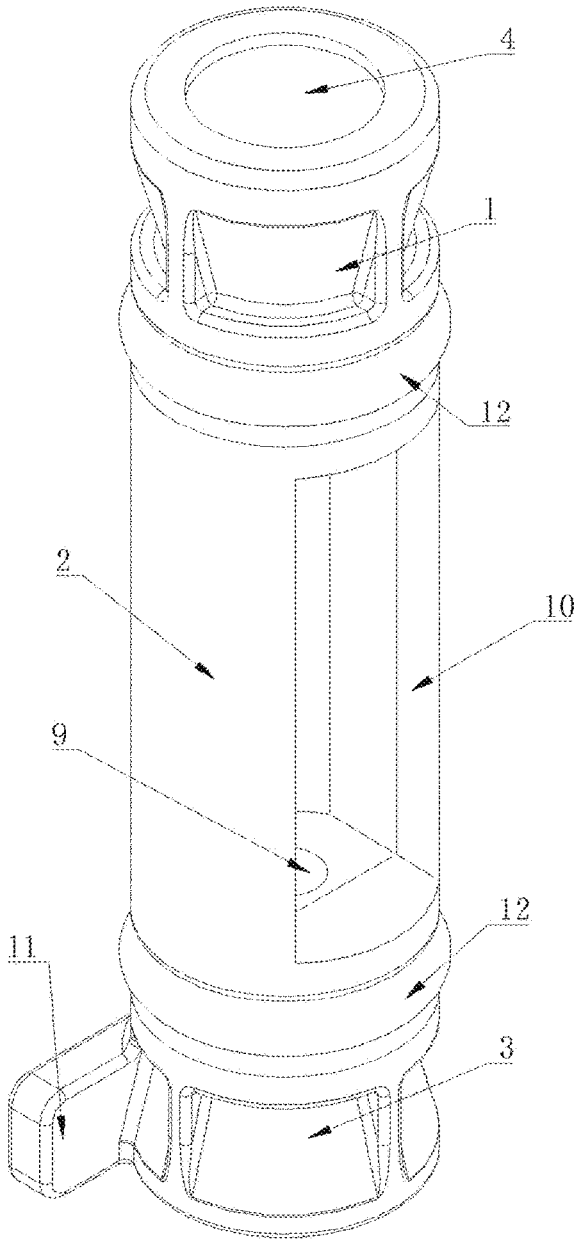
Figure 3:
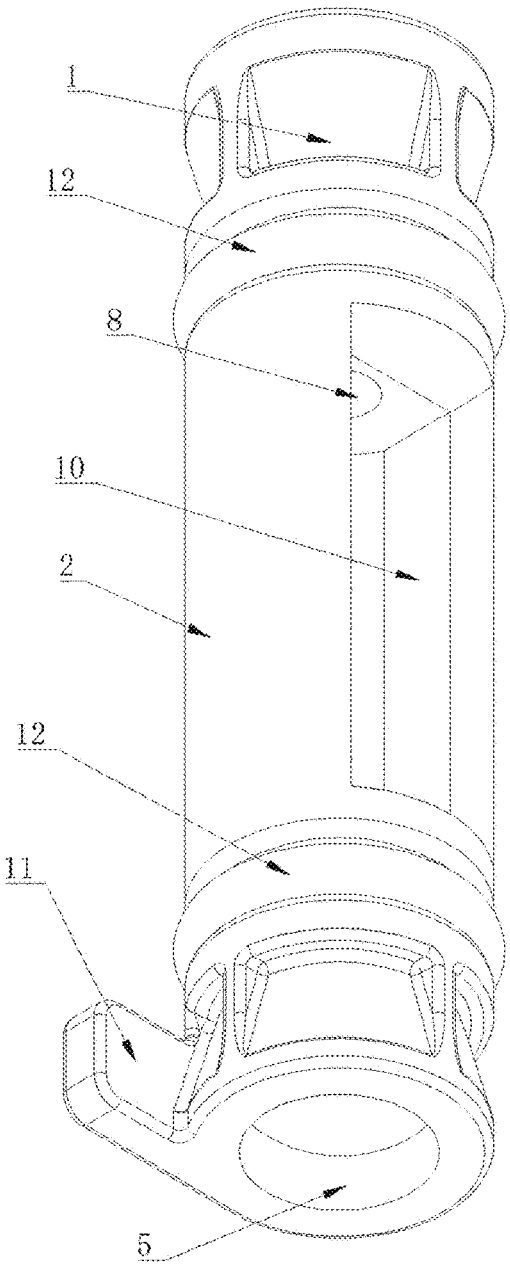
Figure 4:
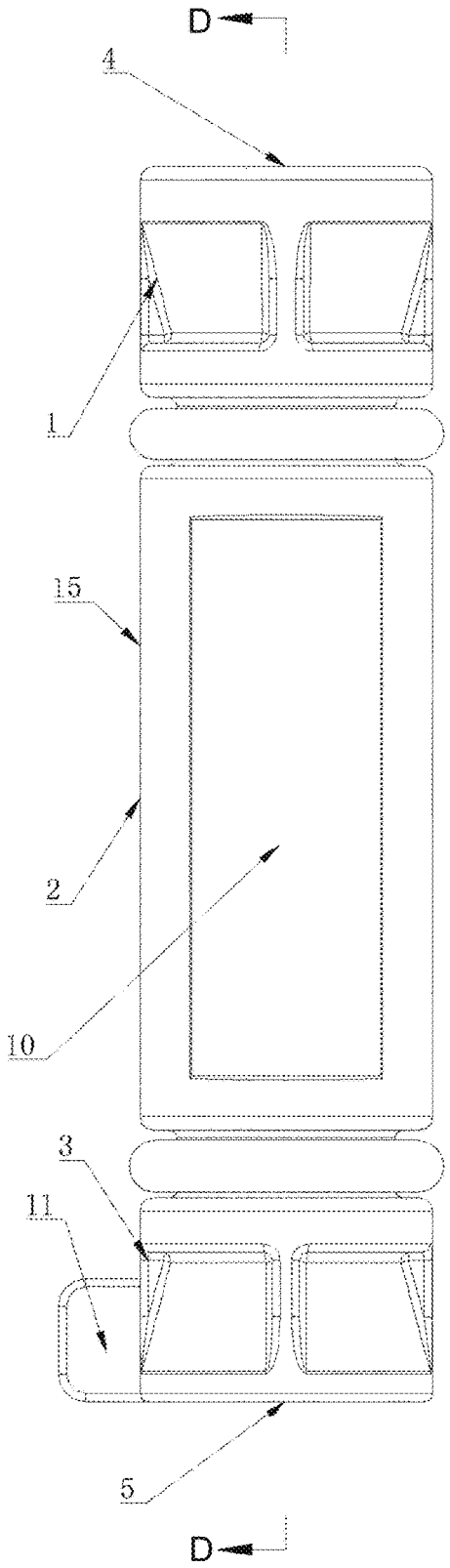
FIG. 4 is a schematic bottom view of an ejector according to an embodiment of the present disclosure.
Figure 5:
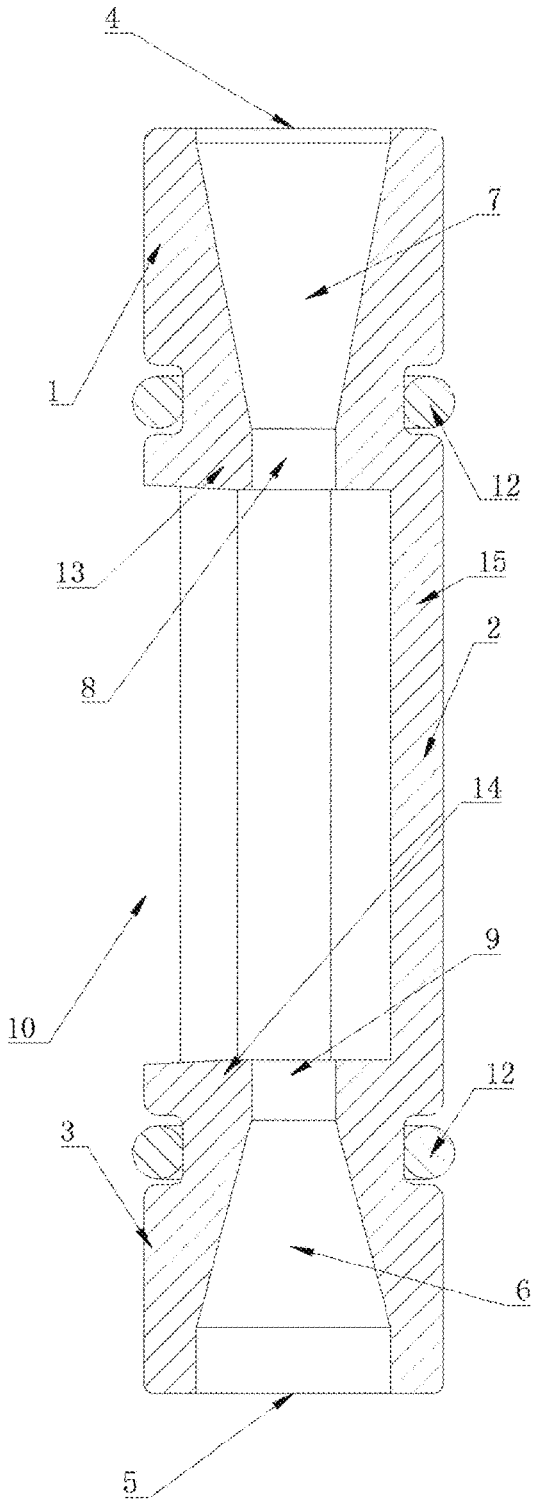
FIG. 5 is a schematic diagram of the section D-D in FIG. 4 according to an embodiment of the present disclosure.
Figure 6:
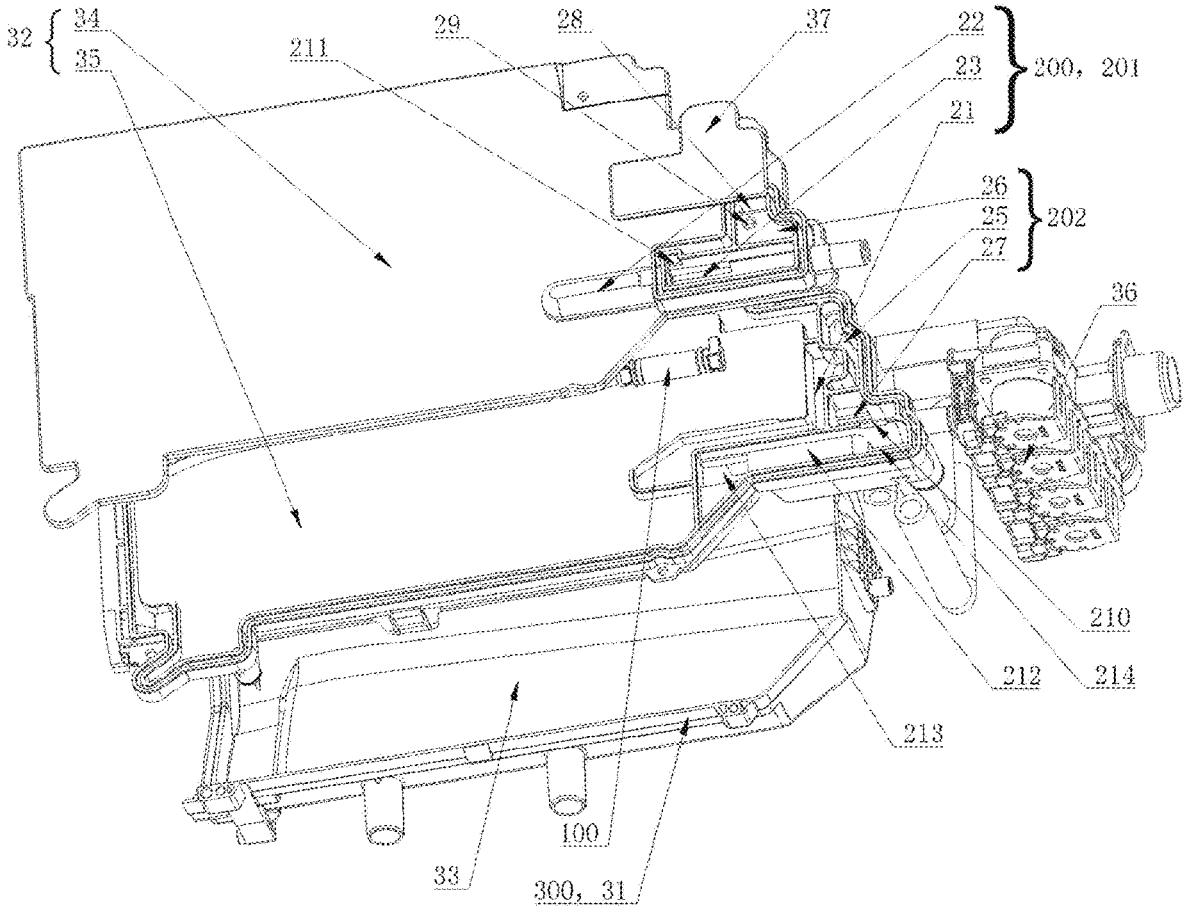
FIGS. 6-7 are schematic exploded views of a dispensing device according to an embodiment of the present disclosure.
Figure 7:
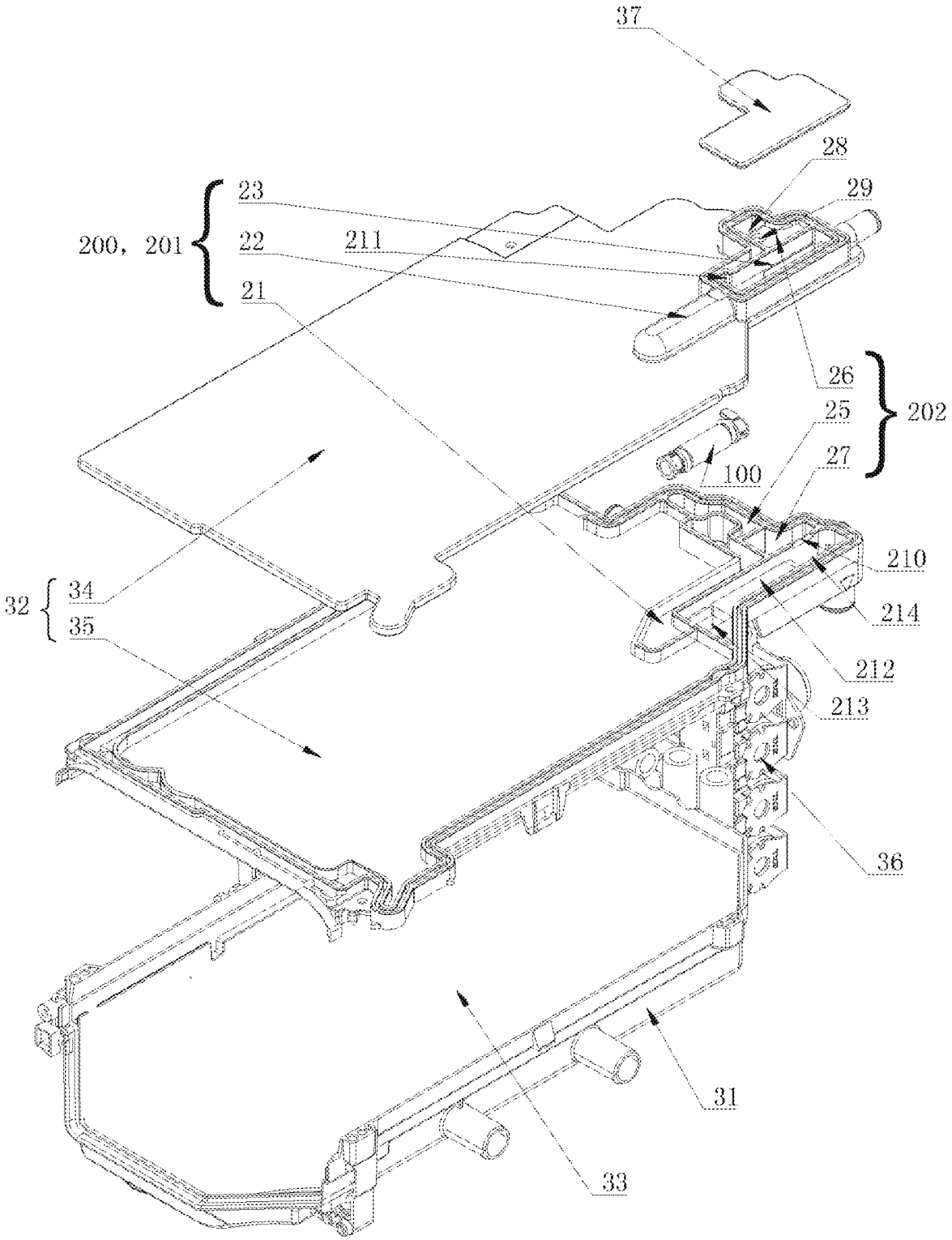
Figure 8:
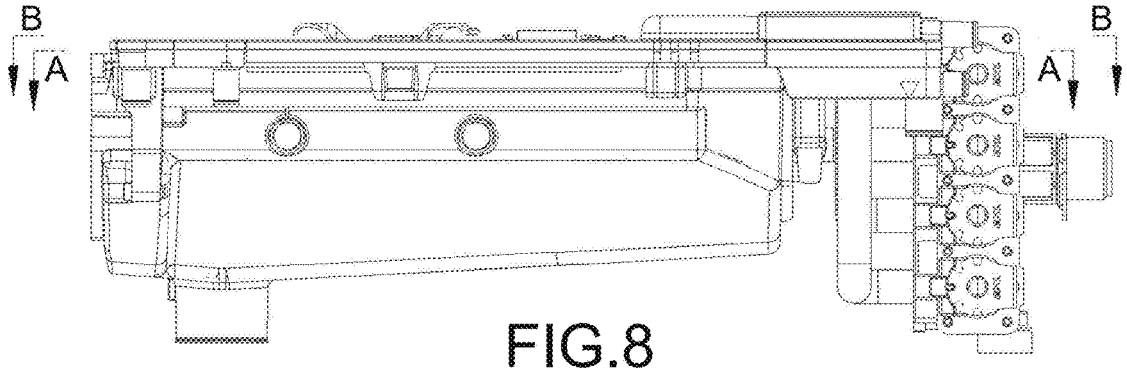
FIG. 8 is a schematic side view of a dispensing device according to an embodiment of the present disclosure.
Figure 9:
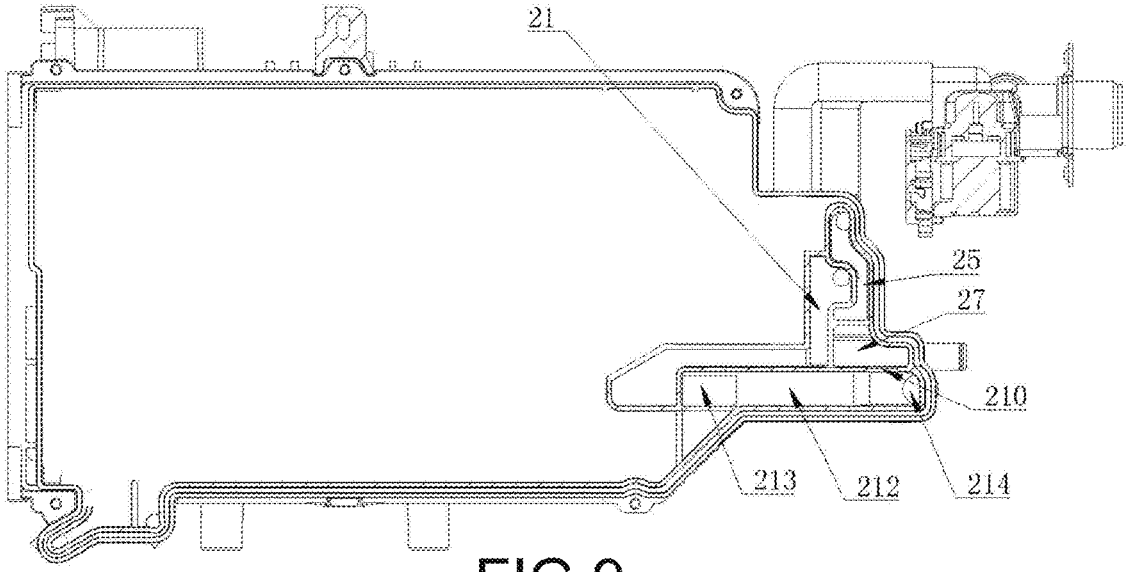
FIG. 9 is a schematic diagram of the section A-A in FIG. 8 according to an embodiment of the present disclosure.
Figure 10:
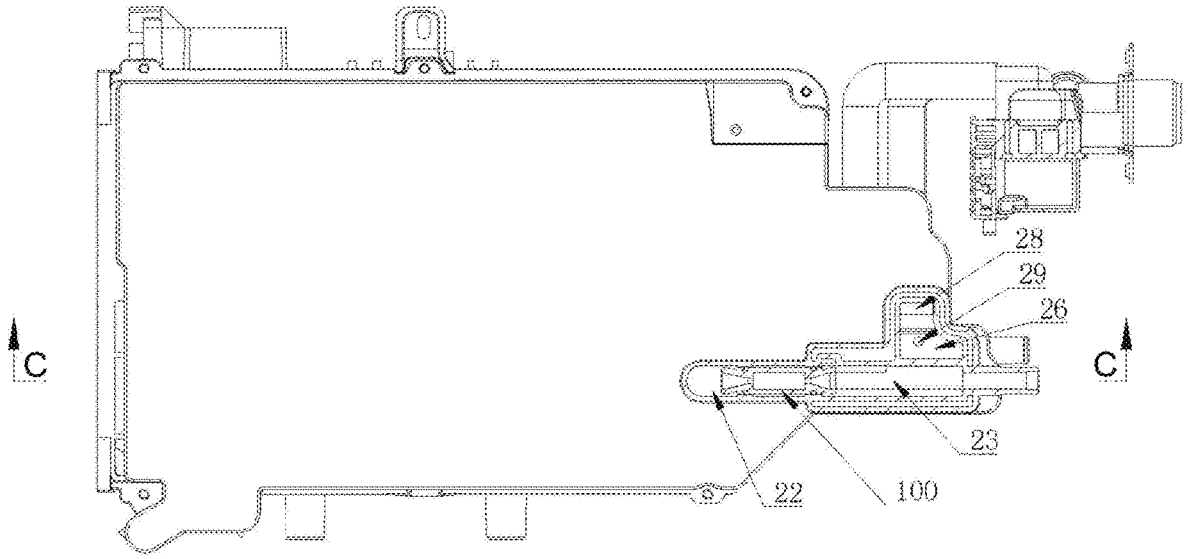
FIG. 10 is a schematic diagram of the section B-B in FIG. 8 according to an embodiment of the present disclosure.
Figure 11:
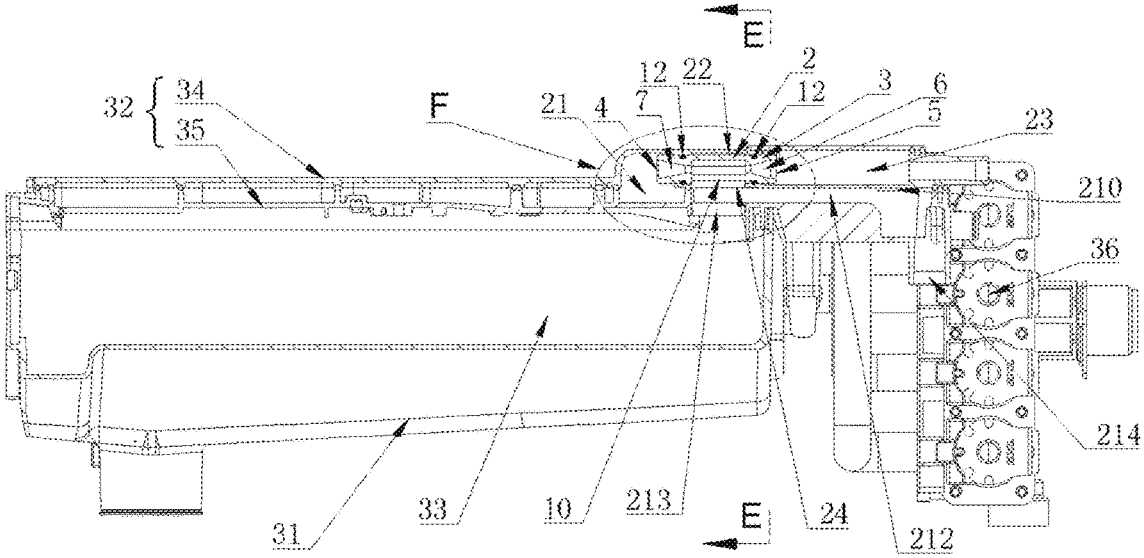
FIG. 11 is a schematic diagram of the section C-C in FIG. 10 according to an embodiment of the present disclosure.
Figure 12:
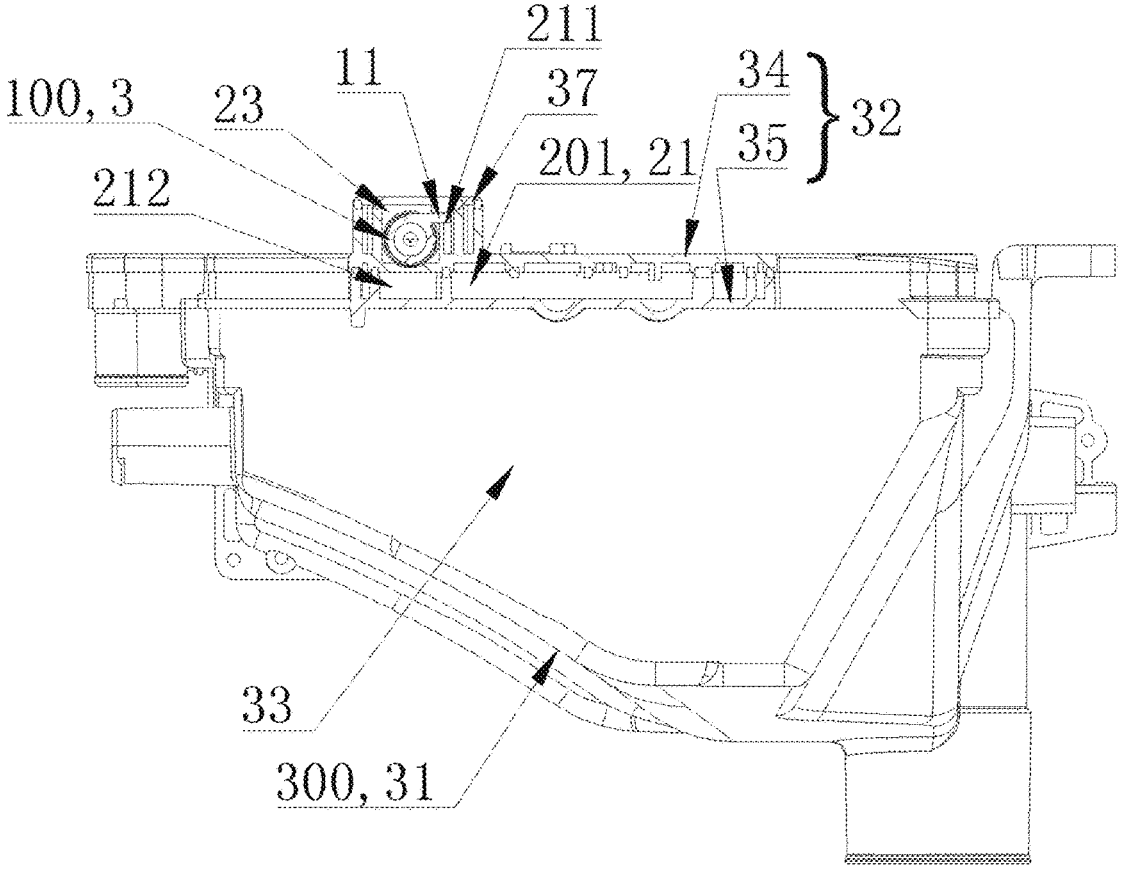
FIG. 12 is a schematic diagram of the section E-E in FIG. 11 according to an embodiment of the present disclosure.
Figure 13:
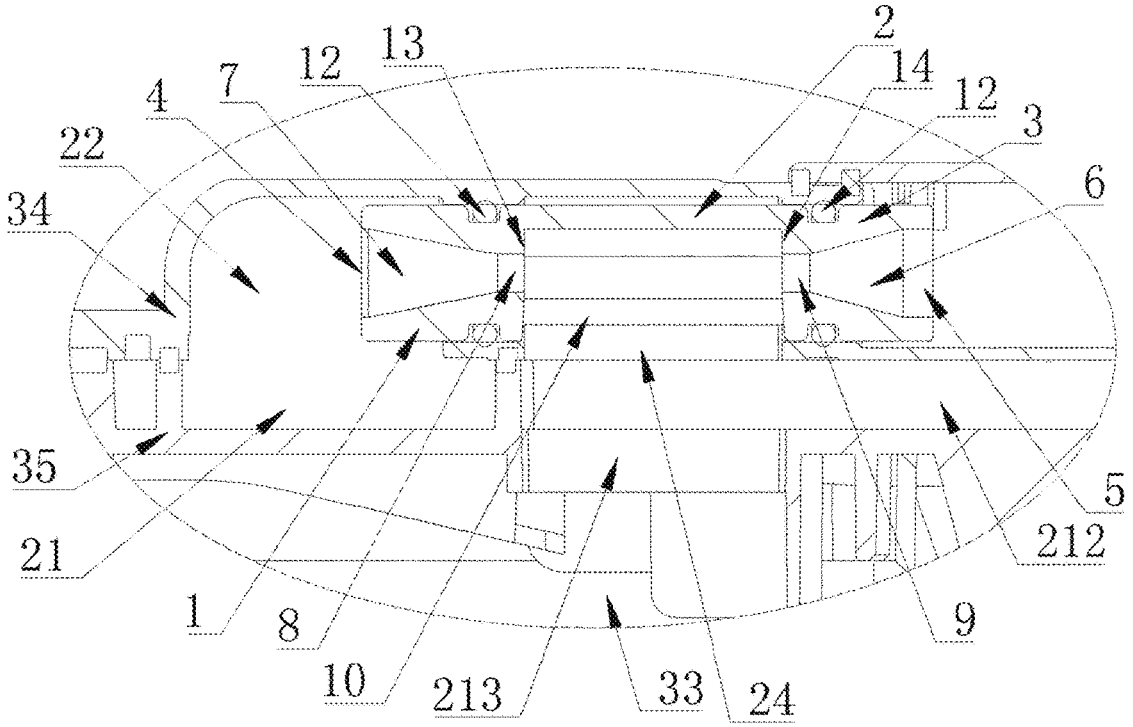
FIG. 13 is a schematic enlarged view of position F in FIG. 11 according to an embodiment of the present disclosure.

Description of main components: 100, ejector; 200, water supply waterway; 300, dispensing device; 1, front chamber portion; 2, connection portion; 3, rear chamber portion; 4, water inlet; 5, water outlet; 6, first conical flow channel; 7, second conical flow channel; 8, ejection hole; 9, injection hole; 10, gap; 11, mounting rib; 12, sealing ring; 13, front end wall; 14, rear end wall; 15, housing; 201, first water supply waterway; 202, second water supply waterway; 21, first water inlet chamber; 22, mounting chamber; 23, first water outlet chamber; 24, opening; 25, second water inlet chamber; 26, water passing chamber; 27, second water outlet chamber; 28, water passing inlet; 29, water passing outlet; 210, ventilation port; 211, positioning groove; 212, ventilation passage; 213, opening; 214, overflow port; 31, water box; 32, upper cover; 33, water inlet chamber; 34, upper cover plate; 35, lower cover plate; 36, water inlet valve; 37, cover plate; 1'—water inlet flow channel segment; 2'—straight flow channel segment; 3'—water outlet flow channel segment.

It needs to be noted that these drawings and written description are not intended to limit the scope of the inventive concept in any way, but rather to illustrate the inventive concept for those skilled in the art by reference to specific embodiments.

DETAILED DESCRIPTION

In order to make the objects, technical solutions and advantages of the embodiments of the present disclosure clearer, the ejector and the dispensing device in the embodiments will be described in detail in conjunction with the accompanying drawings in the embodiments of the present disclosure.

Embodiment 1

As shown in FIGS. 1 to 5, an ejector 100 is described in this embodiment. The ejector 100 is mainly used to supply water to laundry treatment appliance such as a washing machine or a drying machine, so that the inlet water flow can be pressurized by the ejector to obtain an inlet water flow with increased water pressure, and a the inlet water flow can be prevented from flowing backward, so the water flows mixed with additives are prevented from crossing each other.

In this embodiment, the ejector 100 for a laundry treatment appliance has a passage for allowing water flow to flow through formed by a front chamber portion 1, a connection portion 2 and a rear chamber portion 3 which are connected in sequence. In this embodiment, two ends of the front chamber portion 1 of the ejector are provided with a water inlet 4 of the ejector and an ejection hole 8 respectively, the water inlet 4 communicates with the upstream water channel, and the ejection hole 8 communicates with the connection portion 2. Two ends of the connection portion 2 respectively communicate with the ejection hole 8 of the front chamber portion 1 and an injection hole 9 of the rear chamber portion 3. The connection portion 2 is provided with a gap 10 enabling the passage in the ejector 100 to communicate with the outside atmosphere, and the gap 10 is configured to discharge water flowing backward from the rear chamber portion 3, so as to prevent water in the waterway equipped with the ejector from flowing back. Two ends of the rear chamber portion 3 are provided with the injection hole 9 and a water outlet 5 of the ejector 100, respectively. The injection hole 9 communicates with the connection portion 2 and is opposite to the ejection hole 8, so that water flowing into the connection portion 2 from the injection hole 9 can jump over the gap 10 formed in the connection portion 2 under the action of own water pressure and be directly injected into the ejection hole 8 formed in the rear chamber portion 3, so as to achieve the effects of smooth water inlet of the water flowing into the ejector 100 without interference from the gap.

In this embodiment, the rear chamber portion 3 has a variable-diameter flow channel with the cross-sectional dimension gradually increasing in the direction of water flow, and a small opening end of the variable-diameter flow channel directly communicates with the injection hole 9. The water inlet end of the rear chamber portion 3 is formed by a narrowed flow channel, so that it is reduced in the flow rate and pressure of the backflow water in the rear chamber portion 3, and further the backflow water is prevented from jumping over the gap 10 and flowing into the front chamber portion 1. Since the injection hole 9 of the rear chamber portion 3 communicates with the narrowed flow channel, the hole diameter of the place where the rear chamber portion 3 communicates with the gap 10 becomes smaller, so that the pressure of the water flow in the rear chamber portion 3 is not relieved, to maintain the pressure of the water flow in the rear chamber portion 3.

In this embodiment, the ejection hole 8 and the injection hole 9 of the ejector 100 are arranged coaxially, and water flowing out of the ejection hole 8 directly flows into the injection hole 9 through the flow channel formed by the connection portion 2, so that the water ejected from the ejection hole 8 can be directly injected into the injection hole 9 without interference, and the inlet water flow passes over the gap 10 and smoothly flows in.

In this embodiment, the connection portion of the ejector 100 is of a cylindrical structure, the front chamber portion 1 and the rear chamber portion 3 are respectively located at two ends of the connection portion 2 of the cylindrical structure, and the ejection hole 8 of the front chamber portion 1 and the injection hole 9 of the rear chamber portion 3 are coaxial with, or parallel to, the axis of the connection portion 2 of the cylindrical structure. Preferably, the injection hole 9 and the ejection hole 8 are arranged close to the axis of the cylindrical connection portion 2 to reduce the interference of the inlet water flow by the inner wall of the cylindrical connection portion 2.

In this embodiment, in order to ensure the water flow to pass over and to improve the pressure maintaining effect of the ejector 100, the following settings are made. A hole diameter of the cylindrical connection portion 2 is greater than the diameters of the injection hole 9 and the ejection hole 8. Preferably, the hole diameter of the cylindrical connection portion 2 is much greater than the diameters of the injection hole 9 and the ejection hole 8, Further preferably, the hole diameter of the cylindrical connection portion 2 is greater than twice the diameter of the injection hole 9 and greater than twice the diameter of the ejection hole 8, so that the water inlet end of the rear chamber portion is not open, but the variable-diameter flow channel communicates with the connection portion via the open, thereby achieving the effect of maintaining the pressure of the water flow in the rear chamber portion.

As shown in FIGS. 1-5, in this embodiment, the ejector 100 is a separate piece formed by a cylindrical housing 15, and the inside of the cylindrical housing 15 is hollow to define a flow channel of which the axis is extended in a straight line. The inside of the flow channel is provided with two partition ribs arranged at intervals, which are a front end wall 13 and a rear end wall 14 respectively and configured to divide the flow channel inside the housing 15 into three parts. A part of the housing 15 between the front end wall 13 and the rear end wall 14 forms the connection portion 2. Two ends of the flow channel of the housing 15 form the water inlet 4 and the water outlet 5 respectively, the flow channel part between the water inlet 4 and the front end wall 13 forms the front chamber portion 1, and the flow channel part between the water outlet 5 and the rear end wall 14 forms the rear chamber portion 3. The ejection hole 8 is formed in the front end wall 13, the injection hole 9 is formed in the rear end wall 14, and the injection hole 9 and the ejection hole 8 are coaxial and arranged close to the axial direction of the cylindrical housing 15. The middle of the side wall of the housing 15 is provided with a notch, which forms the gap 10 that enables the connection portion 2 to communicate with the outside atmosphere.

As shown in FIGS. 1 to 5, in this embodiment, the variable-diameter flow channel in the rear chamber portion 3 is a first conical flow channel 6 extending in an axis of the injection hole 9. The small mouth end of the first conical flow channel 6 is connected and coaxial with the injection hole 9, a diameter of the injection hole is same that of the small mouth end of the first conical flow channel 6. A large mouth end of the first conical flow channel 6 is connected with the water outlet 5 located on the side of the rear chamber portion 3 away from the connection portion, and the water outlet 5 is connected with a waterway located downstream of the ejector 100. The first conical flow channel 6 is coaxial with the injection hole 9. Preferably, the diameter of the large mouth end of the first conical flow channel 6 is greater than the diameter of the ejection hole 8 and smaller than or equal to the diameter of the connection portion 2 with a shape of cylinder.

In this embodiment, although the variable-diameter flow channel is described as being cone-shaped, the variable-diameter flow channel according to the present disclosure is not limited to the cone shape. The variable-diameter flow channel may be of a flow channel in which only one or more sides are bevels and the cross-sectional area is increased in the direction of the inlet water flow.

In this embodiment, the front chamber portion 1 is formed by a second conical flow channel 7 of which the cross-sectional area is gradually decreased in the direction of the water flow, and is configured to pressurize the water flowing out of the ejection hole 8, so that the water flowing out of the ejection hole 8 is pressurized to pass over the connection portion 2, and is avoided from flowing out from the gap 10 to affect the smoothness of water inlet. Preferably, the small mouth end of the second conical flow channel 7 communicates with and is coaxial with the ejection hole 8 of the front chamber portion 1, and a diameter of the small mouth end of the second conical flow channel is same with that of the ejection hole. The large mouth end of the second conical flow channel 7 is arranged on the side of the front chamber portion 1 away from the connection portion 2 and forms the water inlet 4 communicating with the waterway located upstream of the ejector 100, and the second conical flow channel 7 is coaxial with the ejection hole 8 of the front chamber portion 1.

Similarly, in this embodiment, the flow channel of the front chamber portion is set as the cone shape for pressurizing the water flowing out of flow channel. However, in the present disclosure, the flow channel provided in the front chamber portion is not limited to the cone shape, but may also be of a flow channel structure in which only one or more sides are bevels and the cross-sectional area decreases in the direction of the inlet water flow.

In this embodiment, one side of the connection portion 2 with a shape of cylinder is provided with a square notch extending in the axial direction, and the notch forms the gap 10 enabling the flow channel of the ejector to communicate with the outside atmosphere. Preferably, the connection portion 2 with a shape of cylinder is extended in a horizontal direction, and the notch formed on the side wall of the connection portion 2 faces downward. Further preferably, the axes of the injection hole 9 and the ejection hole 8 are eccentrically arranged slightly relative to the side of the notch away from the axis of the cylindrical connection portion 2, thereby allowing the backflow water to be discharged smoothly from the notch and further reducing the possibility of flowing back to the front chamber portion 1. In addition, the gap 10 arranged on one side of the connection portion 2 has a width in a radial direction of the connection portion 2 with a shape of cylinder that is smaller than a diameter of the connection portion 2, and a length in an axial direction of the connection portion 2 with a shape of cylinder that is smaller than or equal to the axial length of the connection portion 2.

In this embodiment, the cross-sectional area of the injection hole 9 is equal to, or approximately equal to, the cross-sectional area of the ejection hole 8, so that the water flow out of the ejection hole 8 can correspondingly fill the injection hole 9. During supplying water, it is ensured that the injection hole 9 is covered by the water flow, and clearance space on the injection hole in communication with the outside atmosphere is reduced, thereby maintaining the pressure of water flowing into the rear chamber portion 3. Preferably, the cross-sectional area of the injection hole 9 is slightly smaller than the cross-sectional area of the ejection hole 8, so that the water flowing to the ejection hole 8 can maximally flow into the injection hole 9, increasing the efficiency of supplying water.

Preferably, as shown in FIGS. 1 to 5, in this embodiment, the injection hole 9 and the ejection hole 8 of the ejector 100 are coaxial circular holes, and the diameter of the injection hole 9 is smaller than the diameter of the ejection hole 8 and greater than seven tenths of the diameter of the ejection hole 8. The injection hole 9 and the ejection hole 8 of the ejector 100 may also be holes with any cross-section, such as square, oval, polygonal, etc.

In this embodiment, the front chamber portion 1, the connection portion 2, and the rear chamber portion 3 of the ejector 100 are coaxial, and the flow channels arranged in the front chamber portion 1, the connection portion 2, and the rear chamber portion 3 communicate in sequence to form a passage allowing water flow to flow through, and the axis of the passage is extended in a straight line. Preferably, the front chamber portion 1, the connection portion 2, and the rear chamber portion 3 are integrally arranged to form an integral piece with a shape of cylinder, and two ends of the integral piece a shape of cylinder respectively form a water inlet 4 and a water outlet 5, and the side wall of the integral piece with a shape of cylinder is provided with a gap 10 formed by a notch.

Preferably, in this embodiment, the cylindrical outer wall of the ejector 100 is provided with at least one sealing ring 12 for sealing the gap between the outer wall of the ejector 100 and the inner wall of the waterway after the ejector 100 is mounted in the waterway, so that the water flow in the upstream waterway can only flow through the flow channel inside the ejector 100 to the downstream waterway. Further preferably, the upstream side and the downstream side of the gap 10 of the ejector 100 are each provided with at least one sealing ring 12, so that it is ensured that water flow in the waterway in which the ejector 100 is mounted does not escape from the gap 10.

Embodiment 2

As shown in FIGS. 1 to 13, a dispensing device 300 is described in this embodiment. The dispensing device includes a water supply waterway 200, an ejector 100 is mounted on the water supply waterway 200, and the ejector 100 is provided with a backflow-preventing gap 10 for enabling the water supply waterway 200 to communicate with the outside atmosphere. The ejector 100 is provided with a variable-diameter flow channel located downstream of the backflow-preventing gap 10 and with the cross-sectional area gradually increasing in the direction of water flow.

In this embodiment, the ejector 100 is mounted in the water supply waterway 200, a water inlet 4 and a water outlet 5 of the ejector 100 communicate with the upstream side and downstream side of the water supply waterway 200, respectively, so that the inlet water flow in the water supply waterway 200 needs to flow through the flow channel inside the ejector 100. The inlet water flow in the ejector 100 is subjected to the action of the variable-diameter flow channel located downstream of the gap 10, to maintain the pressure of the inlet water flow, so it is avoided pressure relief in the downstream of the gap 10 is occurred due to the arrangement of the gap in the water supply waterway. Thereby the water supply waterway 200 can provide high-pressure water flow while preventing from flowing back.

As shown in FIGS. 1 to 13, in this embodiment, the ejector 100 is an ejector 100 in Embodiment 1, and the gap 10 of the ejector 100 in Embodiment 1 constitutes the backflow-preventing gap 10. The ejector in this embodiment may also be any other structure of an ejector (not illustrated in the drawings) provided with a backflow-preventing gap and a variable-diameter flow channel downstream of the backflow-preventing gap.

As shown in FIGS. 6 to 11, in this embodiment, the water supply waterway 200 is provided with a mounting chamber 22, the ejector 100 is arranged in the mounting chamber 22, and an opening 24 is formed in the mounting chamber 22. The backflow-preventing gap 10 of the ejector 100 faces the opening 24, so that the flow channel inside the ejector 100 communicates with the outside atmosphere through the backflow-preventing gap 10 and the opening 24.

In the embodiment, in order to ensure the air-tightness of the water supply waterway 200, at the outer periphery of the ejector 100, the upstream and downstream sides of the backflow-preventing gap 10 are each provided with a sealing ring 12. The outer periphery of the sealing ring 12 is in sealing contact with the inner wall of the water supply waterway 200 so that water in the water supply waterway 200 is not leaked from the opening 24.

In addition, in order that water smoothly flows in the water supply waterway, the axis of the mounting chamber 22 is extended in a straight line, so that the water flowing out from the water outlet 5 of the ejector 100 continues to flow in a straight line. Thereby the pressure-maintaining effect of the water supply waterway 200 is improved and the water flows more smoothly.

In this embodiment, the dispensing device 300 includes a water box 31, the inner space of the water box 31 defines a water inlet chamber 33 communicating with the outside atmosphere. The front end of the water box 31 is open, the top wall of the water box 31 is formed by an upper cover 32, and the water inlet chamber 33 communicates with the outside atmosphere through the opening at the front end of the water box 31. The water supply waterway 200 is integrally arranged on the upper cover 32 of the water box 31, and the backflow-preventing gap 10 of the ejector 100 faces downward and communicates with the water inlet chamber 33 of the water box 31, so that the water flowing backward from the backflow-preventing gap 10 falls directly into the water inlet chamber 33 of the water box 31 and flows out of the dispensing device 300 through a water outlet at the bottom of the water inlet chamber 33, and the backflow-preventing gap 10 can communicate with the outside atmosphere through the water inlet chamber 33.

In this embodiment, the water box 31 may be internally provided with a drawer component which can be drawn outward from the front opening and arranged in the water inlet chamber 33, and the drawer portion is internally provided with one or more dispensing chambers for containing different kinds of additives. Other waterways may be integrally arranged on the upper cover 32 of the water box 31, and the additives in the dispensing chambers may be correspondingly dispensed by the waterways, so that different additives may be dispensed by the dispensing device (not shown in the figures).

In this embodiment, the upper cover 32 of the water box 31 is formed by correspondingly connecting a lower cover plate 35 and an upper cover plate 34. The periphery of the upper cover plate 34 is hermetically connected with the periphery of the lower cover plate 35 to form a hollow portion inside, and a plurality of blocking ribs are arranged in the hollow portion so that the hollow portion is divided into a plurality of different waterways. The upper cover 32 in this embodiment may also be set as an integral piece and internally provided with the required waterways.

As shown in FIGS. 6 to 13, in this embodiment, the upper cover plate 34 of the upper cover 32 of the water box 31 is provided with the mounting chamber 22 upward protruding and a first water outlet chamber 23, and the mounting chamber 22 communicate with the first water outlet chamber 23. The bottom of the end of the mounting chamber 22 away from the first water outlet chamber 23 is provided with the opening 24, the opening 24 enables the mounting chamber 22 formed at the upper side of the upper cover plate 34 to communicate with the first water inlet chamber 21 formed below the upper cover plate 34 and located between the upper cover plate 34 and the lower cover plate 35. The top of one end of the first water inlet chamber 21 communicates with the mounting chamber 22 through the opening 24, and the bottom of the other end of the first water inlet chamber 21 is connected to an external pipe and a water inlet valve 36 through a connector to form the water supply waterway 200, i.e., the first water supply waterway 201. The ejector 100 is mounted in the water supply waterway 200.

In this embodiment, a sealing structure is arranged between the ejector 100 and the inner wall of the water supply waterway 200 to separate the opening 24 from the water supply waterway 200 on the upstream side and downstream side of the ejector 100, so as to avoid that water in the water supply waterway directly flows out from the opening and into the gap to affect the water flow in the flow channel of the ejector.

In this embodiment, the housing 15 of the ejector 100 at the upstream side and downstream side of the backflow-preventing gap 10 are each provided with at least one ring of sealing structure radially outwardly protruding, respectively, so the first water inlet chamber 21 and the first water outlet chamber 23 are separated from the opening 24. In this embodiment, the sealing structure may be any structure with fluid sealing function in the prior art, such as a sealing ring and a sealing gasket. Preferably, in this embodiment, the sealing structure employs a sealing ring 12 sleeving the outer wall of the housing 15 of the ejector 100. The sealing ring 12 is made of material which is elastically deformable, such as rubber. The periphery of the sealing ring 122 is in sealing contact with the inner wall of the water supply waterway 200 to separate the upstream waterway from the downstream waterway, further to form the sealing structure.

Preferably, in this embodiment, the housing 15 of the ejector 100 is provided with mounting grooves being inwardly recessed, and the sealing rings 12 are arranged in the mounting grooves in one-to-one correspondence for positioning the sealing rings 12 in the axial direction.

In this embodiment, the sealing ring 12 on the upstream side of the backflow-preventing gap 10 on the ejector 100 with a shape of cylinder is arranged downstream of the strip-shaped mounting chamber 22 communicating with the first water inlet chamber 21. And the sealing ring 12 on the downstream side of the backflow-preventing gap 10 on the cylindrical ejector 100 is arranged upstream of the strip-shaped mounting chamber 22 communicating with the first water outlet chamber 23.

In this embodiment, the first water inlet chamber 21 is arranged below the strip-shaped mounting chamber 22, and the bottom wall of the water inlet end of the mounting chamber 22 is provided with a through hole communicating with the first water inlet chamber 21 below. At least a portion of the ejector 100 with a shape of cylinder is arranged above the through hole, and the end of the ejector 100 arranged above the through hole is a water inlet 4. The water inlet 4 is spaced from the inner wall surface of the strip-shaped mounting chamber 22 to ensure to smoothly flow water in the ejector 100.

In this embodiment, the mounting chamber 22 and the first water outlet chamber 23 are coaxially arranged so that the axes of the flow channels formed by the mounting chamber 22 and the first water outlet chamber 23 are in a straight line, thereby allowing water flow to flow smoothly.

In this embodiment, the ejector 100 is coaxially inserted into the mounting chamber 22, the front chamber portion 1 and the connection portion 2 of the ejector 100 are correspondingly inserted into the first water inlet chamber 21, and the sealing ring 12 arranged at the junction of the front chamber portion 1 and the connection portion 2 of the ejector 100 is in sealing contact with the inner wall of the mounting chamber 22, so that the upstream portion and the downstream portion of the mounting chamber 22 are separated, and the water flow flowing into the mounting chamber 22 from the first water inlet chamber 21 can only flow into the flow channel inside the ejector 100. The bottom of the side of the mounting chamber 22 close to the first water outlet chamber 23 is provided with an opening 24, and the opening 24 is located on the downstream side of the sealing ring 12 arranged at the junction of the front chamber portion 1 and the connection portion 2 of the ejector 100. The opening communicates with a ventilation passage 212 arranged between the upper cover plate 34 and the lower cover plate 35. The ventilation passage 212 is provided with an opening 213 extending through the lower cover plate 35. The opening 213 enables the ventilation passage 212 to communicate with the atmosphere through the water inlet chamber 33 of the water box 31. The gap 10 for preventing from flowing back in the connection portion 2 of the ejector 100 faces the opening 24, and the opening 213 is formed below the opening 24, so that the ejector 100 can directly communicate with the water inlet chamber 33 of the water box 31 through the gap 10 for preventing from flowing back, the opening 24, and the opening 213. The sealing ring 12 arranged at the junction of the rear chamber portion 3 of the ejector 100 and the connection portion 2 is located in the mounting chamber 22 downstream of the opening 24, and is in sealing contact with the inner wall of the mounting chamber 22, so that the mounting chamber 22 is separated from the first water outlet chamber 23. So the first water outlet chamber 23 does not communicate directly with the atmosphere through the gap 10, and the waterway downstream of the ejector is separated from the gap 10 for preventing from flowing back, thereby maintaining the pressure.

The upstream side and downstream side of the gap 10 of the ejector 100 are each provided with a sealing ring 12 sleeving on the outer circumference. The ejector 100 is supported and mounted in the water inlet chamber 33 by the two sealing rings 12. The front and rear ends of the ejector 100 is supported in the axial direction respectively, so that the ejector 100 can be stably mounted in the water supply waterway 200.

In this embodiment, the top of the first water outlet chamber 23 is provided with a detachable cover plate 37, so that the ejector 100 can be subjected to operations such as mounting and replacing after the cover plate 37 is detached. In order to keep the air-tightness of the water supply waterway 200, a ring of sealing structure is arranged at the junction of the cover plate 37 and the upper cover 32 to ensure that there is a gap between the cover plate 37 and the upper cover 32 of the water inlet chamber 33.

As shown in FIGS. 1 to 13, in this embodiment, the peripheral wall of the ejector 100 is provided with a mounting rib 11 protruding outwardly, and the mounting rib 11 is arranged on the upper cover 32 of the water box 31 to avoid the rotation of the ejector 100 in axial direction after the ejector 100 is mounted in the mounting chamber 22. The mounting rib 11 is located between the cover plate 37 and the upper cover plate 34 of the upper cover 32 to circumferentially limit the ejector 100 in two different directions, thus the ejector 100 is effectively prevented from circumferentially rotating after being mounted. Preferably, the mounting rib 11 is arranged at the rear chamber portion 3 of the ejector 100, the mounting rib 11 does not interfere to assembly the ejector when the ejector 100 is inserted into the mounting chamber 22 from the first water outlet chamber 23. Further preferably, the protruding length of the mounting rib 11 is greater than the difference between the radial dimension of the mounting chamber 22 and the radial dimension of the periphery of the ejector 100 with a shape of cylinder, so that the mounting rib can be as a limiting structure. The ejector 100 can abut against the end of the first water outlet chamber 23 for limiting, when the ejector 100 is inserted into the mounting chamber 22 from the first water outlet chamber 23, thereby ensuring that the ejector is mounted in place.

Preferably, as shown in FIGS. 1-11, in this embodiment, one side of the first water outlet chamber 23 is provided with a positioning groove 211 radially extending and downwardly recessed, and the positioning groove is located at the junction of the first water outlet chamber 23 and the mounting chamber 22 for axially fixing the mounting rib 11 after the ejector 100 is mounted. The mounting rib 11 protruding from the periphery of the rear chamber portion 3 of the ejector 100 is inserted into the positioning groove 211 when the ejector is mounted in the mounting chamber 22, and the mounting rib 11 is limited by the positioning groove 211, so that the ejector 100 is fixed in the axial direction after being mounted.

In this embodiment, the top of the upper cover 32 is provided with a positioning groove 211 communicating with the first water outlet chamber 23 and arranged at one side of the first water outlet chamber 23, and the positioning groove 211 is arranged at the junction of the first water outlet chamber 23 and the mounting chamber 22. The mounting rib 11 of the ejector 100 is correspondingly inserted into the positioning groove 211. In this embodiment, the mounting rib 11 is extended in the tangential direction of the outer peripheral wall of the ejector 100 with a shape of cylinder, and the distance between the end of the mounting rib 11 and the center of the ejector 100 with a shape of cylinder is greater than the radial dimension of the mounting chamber 22, so that at least part of the mounting rib 11 can be correspondingly inserted into the positioning groove. The ejector is axially limited in axial direction. By the above arrangement, after the ejector 100 is inserted into the mounting chamber 22 from the first water outlet chamber 23, the ejector 100 is rotated about the axis to make the mounting rib 11 be correspondingly inserted into the positioning groove 211 from the upper opening, and then the cover 37 is snapped, thereby the ejector 100 is fixedly mounted on the dispensing device 300.

Further, in order to fix the ejector 100 in the axial direction after being mounted, other positioning structures may be arranged on the upper cover plate 34 to limit the movement of the mounting rib 11 in the axial direction of the ejector 100. The positioning structure may be any structure known in the art, for example: two ribs upward protruding are formed on the upper cover plate 34, the two ribs is in limiting contact with two opposite sides of the mounting rib 11 in the axial direction of the ejector 100 to fix the ejector 100 in the axial direction. Alternatively, the mounting rib 11 is provided with a positioning projection corresponding to the positioning groove arranged on the upper cover plate 34, and the positioning projection is correspondingly inserted into the positioning groove after the mounting rib 11 is overlapped on the upper cover plate 34, so that the ejector 100 may also be fixed in the axial direction (not shown in the figures).

Embodiment 3

As shown in FIGS. 1 to 13, a laundry treatment appliance is described in this embodiment. The laundry treatment appliance includes a first water supply waterway 201 for providing high-pressure inlet water flow; a second water supply waterway 202 for providing non-high pressure inlet water flow; and the ejector 100 in Embodiment 1 which is mounted in the first water supply waterway 201 to prevent backflow of the water supply waterway and maintain the pressure of the outlet water flow.

In this embodiment, the laundry treatment appliance may be any known appliance capable of treating laundry, such as having any one or a combination of functions of washing, drying, ironing, and the like. In this embodiment, taking a laundry treatment appliance having a drying function as an example, the first water supply waterway communicates with a washing structure arranged on the laundry treatment appliance. The washing structure is used for flushing lint on a lint filter. The lint filter may be a structure for filtering lint during performing drying by the laundry treatment appliance, and may be any one of other existing lint filtering structures applied to the laundry treatment appliance. The second water supply waterway communicates with a condenser arranged on the laundry treatment appliance for supplying water flow for heat exchange to the condenser. The condenser may be a condenser for condensing and exchanging the air flow in the air duct during performing drying by the laundry treatment appliance, or any other existing condenser applied to the laundry treatment appliance.

In this embodiment, the first water supply waterway 201 and the second water supply waterway 202 are integrally arranged on a dispensing device 300 of the laundry treatment appliance, the dispensing device 300 is described in Embodiment 2, and the first water supply waterway 201 is the water supply waterway 200 described in Embodiment 2.

In this embodiment, the second water supply waterway 202 is arranged on an upper cover 32 of the dispensing device 300, the second water supply waterway 202 is provided with a ventilation port 210, and the ventilation port 210 communicates with a gap 10 of the ejector 100 mounted in the first water supply waterway 201 and communicates with the atmosphere through the same ventilation passage 212, so that different water supply waterways in the dispensing device 300 share the same ventilation passage 212. Thereby the structure of the dispensing device is simplified.

In this embodiment, the dispensing device 300 is further provided with the ventilation passage 212, and the two ends of the ventilation passage 212 communicate with the ventilation port 210 of the second water supply waterway 202 and the outside atmosphere respectively, and the gap 10 for preventing from flowing back of the ejector 100 communicates with the ventilation passage 212 through an opening 24 formed in an upper cover plate 34.

In this embodiment, the ventilation passage 212, the first water supply waterway 201 and the second water supply waterway 202 are all integrally formed on the upper cover 32 of a water box 31, and one end of the ventilation passage 212 communicates with a water inlet chamber 33 formed by the water box 31, and the other end of the ventilation passage 212 communicates with the ventilation port 210 of the second water supply waterway 202.

In this embodiment, the second water supply waterway 202 includes a second water inlet chamber 25, a water passing chamber 26 and a second water outlet chamber 27 that communicate in sequence.

The second water inlet chamber 25 is arranged on the upper cover 32 of the water box 31 and located between the upper cover plate 34 and a lower cover plate 35 of the upper cover 32, and the bottom of the second water inlet chamber 25 communicates with a second water inlet pipeline and a water inlet valve 36 through a connector.

The upper part of the second water inlet chamber 25 is provided with the water passing chamber 26, the water passing chamber 26 is protruded above the upper cover plate 34, and the water passing chamber 26 is provided with a water passing inlet 28 and a water passing outlet 29. The water passing inlet 28 and the water passing outlet 29 are arranged at the bottom wall of the water passing chamber 26 in a staggered manner and are both penetrated through the upper cover plate 34. The water passing chamber 26 is communicated with the top of the second water inlet chamber 25 by water passing inlet 28.

The second water outlet chamber 27 is arranged below the water passing chamber 26, and located between the upper cover plate 34 and the lower cover plate 35. The water passing chamber 26 is communicated with the top of the second water outlet chamber 27 by the water passing outlet 29. The bottom of the second water outlet chamber 27 is provided with a second water outlet from which the water flows out of the dispensing device 300, and the second water outlet communicates with a water inlet pipe of the condenser of the laundry treatment appliance via a pipeline, to provide water to the condenser of the laundry treatment appliance for heat exchange.

In this embodiment, the upper of the second water outlet chamber 27 of the second water supply waterway 202 is provided with a ventilation port 210, and the ventilation port 210 is a notch formed at the top of a rib formed on the lower cover plate 35 and being as the side wall of the second water outlet chamber 27, and the notch is used for communicating the second water outlet chamber 27 on two sides of the rib with the ventilation passage 212. The ventilation passage 212 is horizontally extended and is integrally formed on the upper cover 32 of the water box 31. The ventilation port 210 communicates with one end of the ventilation passage 212. The other end of the ventilation passage 212 is provided with an opening 213 communicating with the water inlet chamber 33 below. The opening 213 is penetrated through the lower cover plate 35 of the upper cover 32.

In this embodiment, the ejector 100 in the first water supply waterway 201 is located above the opening 213 of the ventilation passage 212, and the gap 10, for preventing from flowing back, on the ejector 100 faces downward and is aligned to the opening 213 below, so that the gap 10, for preventing from flowing back, of the ejector 100 can directly communicate with the water inlet chamber 33 of the water box 31 through the opening 213.

In this embodiment, the ventilation passage 212 is further provided with an overflow port 214, the overflow port 214 is located close to the ventilation port 210 and is located farther from the opening 213 with respect to the ventilation port 210, and the overflow port 214 communicates with a drain pipe of the laundry treatment appliance for discharging overflow water flow of the laundry treatment appliance. Preferably, in order to smoothly discharge the overflow water flow, the overflow port 214 is arranged at the lower-most of the ventilation passage 212, and the overflow water flow flowing into the ventilation passage 212 can be completely discharged through the overflow port 214. Thereby the dispensing device 300 does not overflow.

Embodiment 4

A dispensing device is described in this embodiment. The dispensing device in this embodiment differs from the dispensing device in Embodiment 3 in that, the ejector is not a separate component, but as a part of the upper cover of the dispensing device integrated on the water supply waterway.

Figure 14:
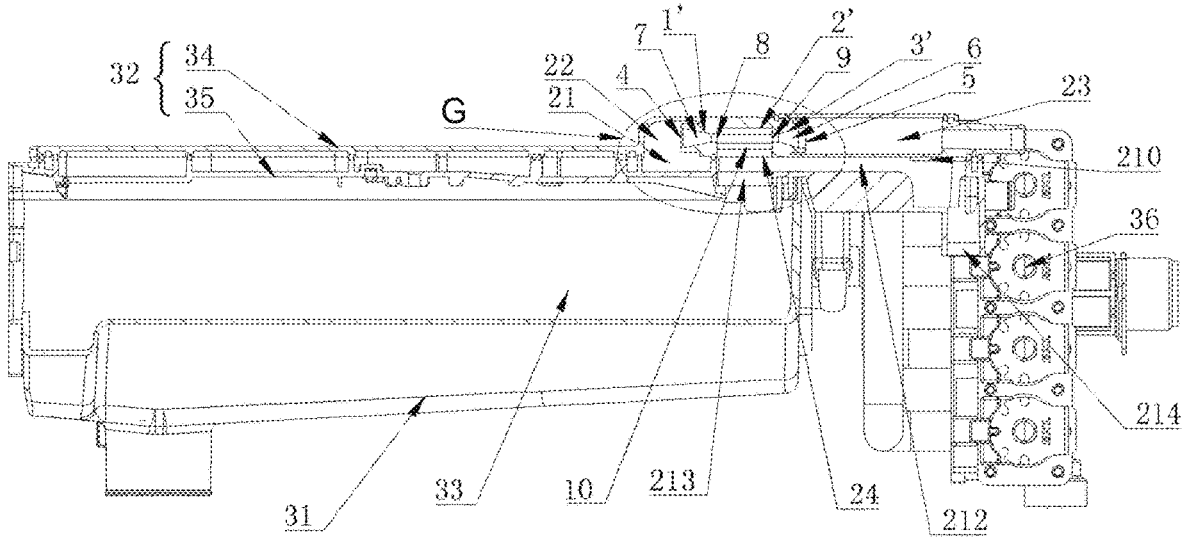
FIG. 14 is a schematic cross-sectional view of a dispensing device according to another embodiment of the present disclosure.
Figure 15:
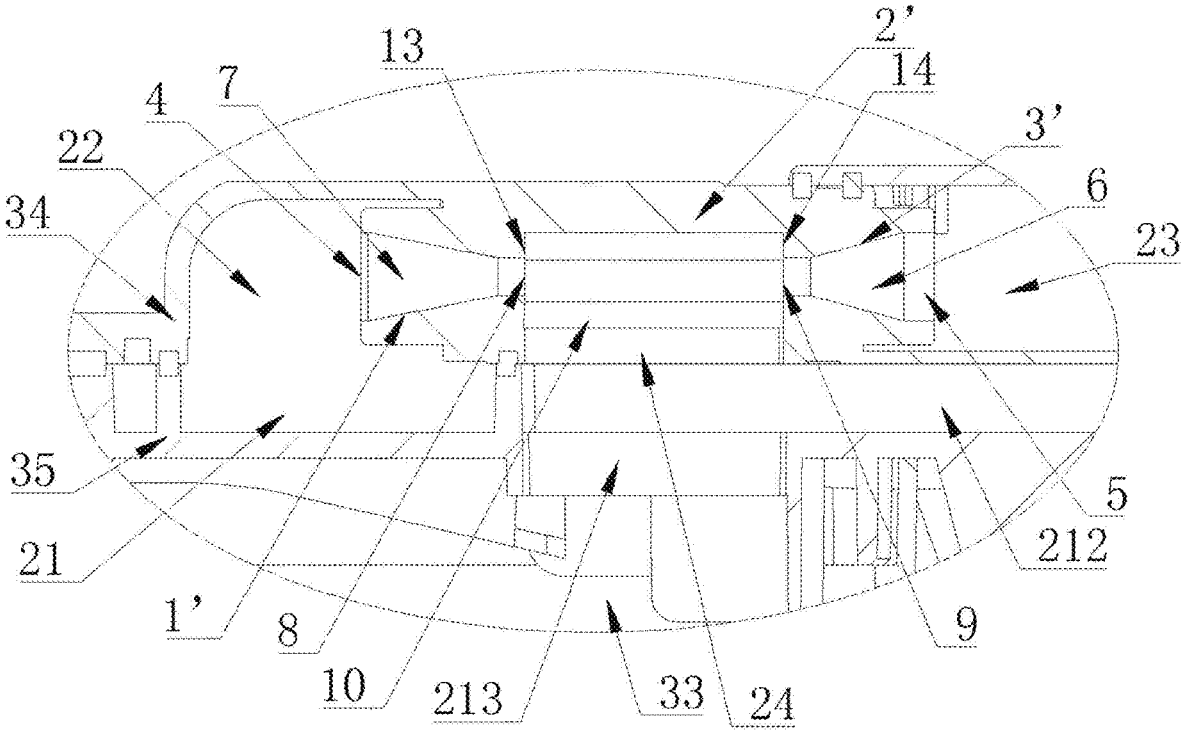
FIG. 15 is a schematic enlarged view of position G in FIG. 14 according to another embodiment of the present disclosure.

As shown in FIGS. 14 and 15, in this embodiment, the dispensing device includes a water supply waterway 200. The water supply waterway 200 is provided with a gap 10 for preventing from flowing back communicating with the outside atmosphere. The water supply waterway 200 is provided with an ejection hole 8 on the upstream side of the gap 10 for preventing from flowing back, and an injection hole 9 on the downstream side of the gap 10 for preventing from flowing back. A center line of the ejection hole 8 is coaxial with a center line of the injection hole 9, and the diameter of the ejection hole 8 is approximately equal to the diameter of the injection hole 9.

In this embodiment, the water supply waterway 200 comprises a straight flow channel segment 2' of which an axis is extended in a straight line, and the side wall of the straight flow channel segment 2' is provided with a notch. The water supply waterway 200 is communicated with the outside atmosphere by notch being as a gap 10 for preventing from flowing back.

In this embodiment, the water supply waterway 200 is internally provided with a front end wall 13 located upstream of the gap 10 and a rear end wall 14 located downstream of the gap 10, the ejection hole 8 is formed on the front end wall 13, and the injection hole 9 is formed on the rear end wall 14. Preferably, both the front end wall 13 and the rear end wall 14 are perpendicular to the axis of the straight flow channel segment 2'.

In this embodiment, the axis of the straight flow channel segment 2' coincides with, or is parallel to, the axes of the ejection hole 8 and the injection hole 9. Preferably, the centers of the ejection hole 8 and the injection hole 9 are arranged substantially at the central axis of the straight flow channel segment 2', and the diameter of the injection hole 9 is slightly smaller than the diameter of the ejection hole 8. Preferably, the difference between the diameters of the injection hole 9 and the ejection hole 8 is smaller than or equal to one fifth of the diameter of the injection hole 9. Further preferably, the difference between the diameters of the injection hole 9 and the ejection hole 8 is smaller than or equal to one tenth of the diameter of the injection hole 9 (similarly, the relationship between the dimensions of the injection hole and the ejection hole of the dispensing device in Embodiment 2 satisfies the above condition).

In this embodiment, the water supply waterway 200 further comprises a water inlet flow channel segment 1' arranged on the upstream side of the front end wall 13, and the water inlet flow channel segment 1' coaxially communicates with the ejection hole 8. The water inlet flow channel segment 1' is a flow channel with the cross-sectional area gradually decreasing in the direction from the water inlet 4 to the ejection hole 8. Preferably, a first flow channel segment with invariable diameter is arranged between the small mouth end of the water inlet flow channel segment 1' and the end face of the ejection hole 8, and the large mouth end of the water inlet flow channel segment 1' is connected with a second flow channel segment with invariably diameter.

In this embodiment, the water supply waterway 200 further comprises a water outlet flow channel segment 3' arranged on the downstream side of the rear end wall 14, and the water outlet flow channel segment 3' coaxially communicates with the injection hole 9. The water outlet flow channel segment 3' is a flow channel with the cross-sectional dimension gradually increasing in the direction of the inlet water flow. The small mouth end of the water outlet flow channel segment 3' communicates with the injection hole 9 and the large mouth end of the water outlet flow channel segment 3' communicates with a downstream waterway Preferably, a flow channel segment with invariable diameter and/or a narrowed flow channel segment narrowed in the direction of the water flow is arranged between the small mouth end of the water outlet flow channel segment 3' and the end face of the injection hole 9.

In this embodiment, the water supply waterway 200 comprises a water inlet chamber and a water outlet chamber in different levels. The water inlet chamber communicates with the gap 10 through the ejection hole 8, and the water outlet chamber communicates with the gap 10 through the injection hole 9, for injecting the water flow in the water inlet chamber into the water outlet chamber to form a waterway for flowing water.

In this embodiment, the mounting chamber 22 is strip-shaped, and the middle of the strip-shaped mounting chamber 22 has the straight flow channel segment 2' of which the side wall is provided with a notch to form the gap 10 for preventing from flowing back. The front end wall 13 with the ejection hole 8 and the rear end wall 14 with the injection hole 9 are arranged at the two ends of the straight flow channel segment 2'. The mounting chamber 22 on the upstream side of the front end wall 13 forms the water inlet flow channel segment 1', and the mounting chamber 22 on the downstream side of the rear end wall 13 forms the water outlet flow channel segment 3'.

In this embodiment, the dispensing device includes a water box 31, the top wall of the water box 31 is formed by the upper cover 32, and the water supply waterway 200 is integrally arranged on the upper cover 32. The upper cover 32 is formed by correspondingly connecting the upper cover plate 34 with the lower cover plate 35 in a snap-fit manner. The water outlet chamber and the mounting chamber 22 are upward protruded from the upper cover plate 34, the mounting chamber 22 is open at one end to communicate with the water outlet chamber, and the injection hole 9 is arranged between the open end of the mounting chamber 22 and the gap for preventing from flowing back. The water inlet chamber is arranged between the upper cover plate 34 and the lower cover plate 35. The other end of the mounting chamber 22 is closed, the bottom of the mounting chamber 22 is provided with a through hole communicating with the water inlet chamber below, and the ejection hole 8 is arranged between the closed end of the mounting chamber 22 and the gap 10 for preventing from flowing back.

In this embodiment, the water supply waterway 200 arranged on the dispensing device 300 may be used as a first water supply waterway 201. The structure of the water inlet chamber and the water outlet chamber of the water supply waterway 200 in this embodiment corresponds to the structure of the first water inlet chamber 21 and the first water outlet chamber 23 of the first water supply waterway 201 of the dispensing device 300 in Embodiment 2, so the description thereof is not repeated.

In this embodiment, a second water supply waterway 202 is also provided, the second water supply waterway 202 is provided with a ventilation port 210, and the ventilation port 210 communicates with the water inlet chamber 33 in the dispensing device 300 through a ventilation passage 212. The gap 10 communicates with the ventilation passage 212 for enabling the backflow water to flow into the water inlet chamber 33 through the ventilation passage 212. Preferably, the front end of the water inlet chamber 33 is open and communicates with the atmosphere, and the gap 10 communicates with the outside atmosphere through the ventilation passage 212 and the water inlet chamber 33.

In this embodiment, the water supply waterway 200 is provided in the dispensing device 300 as the first supply waterway 201, and the second supply waterway 202 is provided in the same manner as in the dispensing device 300 of the second embodiment, and the description thereof is not repeated.

The above description is only a preferred embodiment of the present disclosure without limiting the disclosure in any manner. Although the present disclosure has been disclosed above in terms of preferred embodiments, it is not intended to limit the disclosure, any person familiar with the present patent, without departing from the scope of the technical solution of the present disclosure, can make some changes to the above-described embodiments and modify the embodiments into equivalent embodiments with equivalent changes using the teachings disclosed herein. Any simple modifications, equivalent changes, and modifications made to the above-described embodiments according to the technical essence of the present disclosure without departing from the content of the technical solution of the present disclosure still fall within the scope of the solution of the present disclosure.

The invention claimed is:

1. A dispensing device for a washing machine, comprising:

a water supply waterway, wherein the water supply waterway is provided with an ejector, the ejector is provided with a gap for discharging backflow water downstream of the water supply waterway;

an opening in line with the gap is formed in the water supply waterway; and a sealing structure is arranged between the ejector and an inner wall of the water supply waterway and is configured to separate the opening from the water supply waterway on the upstream and downstream of the ejector.

2. The dispensing device according to claim 1, wherein positions of a housing of the ejector on the upstream and the downstream of the gap are respectively provided with at least one sealing ring being radially outwardly protruded.

3. The dispensing device according to claim 2, wherein the housing of the ejector is in a shape of a cylinder, a flow channel is formed in the housing in an axial direction;

a middle part of a peripheral wall of the housing is provided with a notch as the gap for communicating the flow channel inside the ejector with the outside atmosphere;

the at least one sealing ring being radially outwardly protruded is arranged on an outer wall of the housing of the ejector on two sides of the gap, respectively; and a periphery of the sealing ring is in hermetical contact with an inner wall of the water supply waterway for forming a sealing structure.

4. The dispensing device according to claim 1, wherein the water supply waterway comprises a mounting chamber arranged on an upper cover of the dispensing device and upwardly protruded;

the mounting chamber with an elongated shape is horizontally extended, and a bottom of the mounting chamber is provided with the opening;

the ejector is in a shape of a cylinder, and the ejector is inserted into and is coaxial with the mounting chamber, and the gap is formed at a middle of a side wall of the ejector, and the gap is arranged above the opening; and at least one sealing ring is respectively arranged on the side wall of the ejector located on two sides of the gap, and the periphery of the sealing ring is in hermetical contact with an inner wall of the mounting chamber.

5. The dispensing device according to claim 4, wherein two ends of the mounting chamber are respectively in communication with a water inlet chamber and a water outlet chamber;

the sealing ring located upstream of the gap on the ejector is arranged downstream of a junction between the mounting chamber and the water inlet chamber; and the sealing ring located downstream of the gap on the ejector is arranged upstream of a junction between the mounting chamber and the water outlet chamber.

6. The dispensing device according to claim 5, wherein the water inlet chamber is arranged below the mounting chamber, and a bottom wall of a water inlet end of the mounting chamber is provided with a through-hole communicating with the water inlet chamber below; and at least part of the ejector is located above the through-hole, and an end of the ejector located above the through-hole is a water inlet, and the water inlet is spaced from the end of the mounting chamber.

7. The dispensing device according to claim 5, wherein the water outlet chamber is in an elongated shape coaxial with the mounting chamber, a radial dimension of the water outlet chamber is greater than a radial dimension of the ejector, and an axial length of the water outlet chamber is greater than or equal to a axial length of the ejector; and a top wall of the water outlet chamber is formed by a cover plate detachably mounted on the upper cover.

8. The dispensing device according to claim 7, wherein at least part of the ejector is located in the water outlet chamber, and an end of the ejector located in the water outlet chamber forms a water outlet;

wherein an outer wall of the ejector is provided with a mounting rib being outwardly protruded, and a protruding length of the mounting rib is greater than a difference between a radial dimension of the mounting chamber and a radial dimension of a periphery of the ejector.

9. The dispensing device according to claim 8, wherein a top of the upper cover is provided with a positioning groove communicating with the water outlet chamber and is arranged at one side of the water outlet chamber, and the positioning groove is arranged at a junction of the water outlet chamber and the mounting chamber; and wherein the mounting rib of the ejector is correspondingly inserted into the positioning groove.

10. The dispensing device according to claim 7, wherein the mounting rib is extended in a tangential direction to an outer wall of the ejector, and a distance between an end of the mounting rib and a center axis of the ejector is greater than a radial dimension of the mounting chamber.

11. The dispensing device according to claim 1, wherein the ejector comprises-:

a housing defining a flow channel for allowing water flow to flow therethrough;

wherein the flow channel of the housing is internally provided with an ejection hole located upstream of the gap and an injection hole located downstream of the gap; and wherein an axis of the ejection hole is coaxial with an axis of the injection hole, and a diameter of the ejection hole is approximately equal to a diameter of the injection hole.

12. The dispensing device according to claim 11, wherein the housing is in a shape of a cylinder, a hollow portion in the cylinder forms the flow channel, and a side wall of the housing with the shape of the cylinder is provided with a notch for communicating a space between the injection hole and the ejection hole with the outside atmosphere.

13. The dispensing device according to claim 12, wherein the flow channel of the housing is internally provided with a front end wall located upstream of the gap and a rear end wall located downstream of the gap; and the ejection hole is formed in the front end wall and the injection hole is formed in the rear end wall.

14. The dispensing device according to claim 13, wherein a part of the housing between the front end wall and the rear end wall forms a connection portion;

an axis of the connection portion is configured to coincide with or to be parallel to, the axis of the injection hole and the axis of the ejection hole.

15. The dispensing device according to claim 14, wherein the axis of the ejection hole and the axis of the injection hole are arranged substantially at an axis of the housing, and a diameter of the injection hole is smaller than a diameter of the ejection hole.

16. The dispensing device according to claim 11, further comprising a front chamber portion arranged upstream of the front end wall, wherein the flow channel in the front chamber portion is in communication with the ejection hole.

17. The dispensing device according to claim 16, wherein an upstream end of the flow channel in the front chamber portion is a water inlet of the ejector;

a downstream end of the flow channel is in communication with the ejection hole; and the flow channel in the front chamber portion is in a cross-sectional area gradually decreasing in a direction from the water inlet to the ejection hole.

18. The dispensing device according to claim 17, wherein a first flow channel with invariable diameter is arranged between a small mouth end of the narrowed flow channel of the front chamber portion and an end face of the ejection hole; and a second flow channel with invariable diameter is arranged between a large mouth end of the narrowed flow channel and an end face of the water inlet.

19. The dispensing device according to claim 11, further comprising a rear chamber portion arranged downstream of the rear end wall;

wherein a flow channel in the rear chamber portion communicates with the injection hole;

wherein the rear chamber portion is provided with a variable-diameter flow channel with a cross-sectional dimension gradually increasing in the direction of water flow; and wherein a small mouth end of the variable-diameter flow channel communicates with the injection hole, and a large mouth end of the variable-diameter flow channel forms a water outlet of the ejector.

* * * * *